US007327828B1

(12) United States Patent
Frontera et al.

(10) Patent No.: US 7,327,828 B1
(45) Date of Patent: Feb. 5, 2008

(54) THERMAL OPTIMIZATION OF FERROFLUID SEALS

(75) Inventors: Mark A. Frontera, Clifton Park, NY (US); Aniruddha Dattatraya Gadre, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/611,057

(22) Filed: Dec. 14, 2006

(51) Int. Cl.
*H01J 35/10* (2006.01)

(52) U.S. Cl. ..... 378/130; 277/302; 277/410
(58) Field of Classification Search ..... 378/130, 378/131, 132, 133; 277/302, 410
See application file for complete search history.

(56) References Cited

U.S. PATENT DOCUMENTS 5,340,122 A * 8/1994 Toboni et al. ..... 277/410

* cited by examiner

*Primary Examiner*—Courtney Thomas
(74) *Attorney, Agent, or Firm*—Jean K. Testa; Curtis B. Brueske

(57) ABSTRACT

A hermetic sealing system includes a chamber enclosing a high vacuum and positioned within an ambient environment and a rotatable shaft having a first portion extending into the chamber and a second portion extending out from the chamber. A ferrofluid seal is positioned about the rotatable shaft and positioned between the first portion and the second portion, the ferrofluid seal fluidically sealing the chamber. The ferrofluid seal assembly also includes a plurality of non-magnetic conductive elements configured to reduce an operating temperature in the ferrofluid seal assembly.

23 Claims, 3 Drawing Sheets

THERMAL OPTIMIZATION OF FERROFLUID SEALS

BACKGROUND OF THE INVENTION

The present invention relates generally to x-ray tubes and, more particularly, to reducing temperature in a ferrofluid seal in the x-ray tube.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across an anode-to-cathode vacuum gap and produces x-rays upon impact with the anode. Because of the high temperatures generated when the electron beam strikes the target, it is necessary to rotate the anode assembly at high rotational speed. This places stringent demands on the bearing assembly, which typically includes tool steel ball bearings and tool steel raceways positioned within the vacuum region, thereby requiring lubrication by a solid lubricant such as silver. In addition, the rotor, as well, is placed in the vacuum region of the x-ray tube. Wear of the lubrication and loss thereof from the bearing contact region increases acoustic noise and slows the rotor during operation. Placement of the bearing assembly in the vacuum region prevents lubricating with wet bearing lubricants, such as grease or oil, and performing maintenance on the bearing assembly to replace the solid lubricant.

In addition, the operating conditions of newer generation x-ray tubes have become increasingly aggressive in terms of stresses because of g forces imposed by higher gantry speeds and higher anode run speeds. As a result, there is greater emphasis in finding bearing solutions for improved performance under the more stringent operating conditions. Placing the bearing assembly and rotor outside the vacuum region of the x-ray tube by use of a hermetic rotating seal, such as a ferrofluid seal, allows the use of wet lubricants, such as grease or oil, to lubricate the bearing assembly. In addition, maintenance may be performed on the bearing assembly and rotor without interrupting the vacuum in the vacuum region.

A ferrofluid seal typically includes a series of annular regions between a rotating component and a non-rotating component. The annular regions are occupied by a ferrofluid that is typically a hydrocarbon-based, silicon-based, or fluorocarbon-based oil with a suspension of magnetic particles therein. The particles are coated with a stabilizing agent, or surfactant, which prevents agglomeration of the particles in the presence of a magnetic field. When in the presence of a magnetic field, the ferrofluid is caused to form a seal between each of the annular regions. The seal on each annular region, or stage, can separately withstand pressure of typically 1-3 psi and, when each stage is placed in series, the overall assembly can withstand pressure varying from atmospheric pressure on one side to high vacuum on the other side.

The ferrofluid seal allows for rotation of a shaft therein designed to deliver mechanical power from the rotor on one side of the seal to the anode on the other side. As such, the rotor may be placed outside the vacuum region to enable conventional grease-lubricated or oil-lubricated bearings to be placed on the same side of the seal as the rotor to support the target. Furthermore, such bearings may be larger than those typically used on the vacuum side.

While the use of ferrofluid seals as described above improves performance in the x-ray tube, such a configuration also introduces issues regarding the thermal load generated by the x-ray tube and the effect it has on the ferrofluid seal. The ferrofluid seal is operated more efficiently if the temperature of the seal is properly managed and maintained below a certain critical point. As ferrofluid seals are sensitive to the ferrofluid temperature therein, the use of ferrofluid seals in a high-temperature environment can reduce efficiency of the ferrofluid seal.

Therefore, it would be desirable to design an apparatus and method to optimize thermal spreading and reduce peak temperatures in a ferrofluid seal.

BRIEF DESCRIPTION OF THE INVENTION

The present invention provides an apparatus for improving an x-ray tube with a ferrofluid seal assembly that overcomes the aforementioned drawbacks. A plurality of non-magnetic conductive elements are included in the ferrofluid seal assembly to reduce an operating temperature in the ferrofluid seal assembly.

According to one aspect of the present invention, a hermetic sealing system includes a chamber enclosing a high vacuum positioned within an ambient environment, a rotatable shaft having a first portion extending into the chamber and a second portion extending away from the chamber, and a ferrofluid seal assembly positioned about the rotatable shaft and positioned between the first portion and the second portion, the ferrofluid seal assembly having a ferrofluid therein that fluidically seals the chamber. The hermetic sealing system also includes a plurality of non-magnetic passive or active conductive elements positioned within the ferrofluid seal assembly and in thermal contact with the ferrofluid.

In accordance with another aspect of the present invention, an x-ray tube includes a vacuum enclosure having a high vacuum formed therein, a ferrofluid seal positioned between the vacuum enclosure and a surrounding environment and having a plurality of ferrofluid seal stages, and a rotatable shaft extending from within the vacuum enclosure and into the surrounding environment through the hermetic seal, wherein the rotatable shaft includes a cavity therein extending from the hermetic seal and out into the surrounding environment. The x-ray tube also includes a plurality of heat transfer mechanisms, each heat transfer mechanism thermally connected to at least two ferrofluid seal stages to axially spread a thermal load of the at least two ferrofluid stages.

In accordance with yet another aspect of the present invention, a method of manufacturing an x-ray tube comprises the steps of providing a rotatable shaft, attaching an anode to a rotatable shaft, disposing the anode in a first volume, and attaching a rotor and a bearing assembly to the rotatable shaft outside of the first volume. The method also includes the steps of attaching a ferrofluid seal assembly to the rotatable shaft to hermetically seal the first volume, the ferrofluid seal assembly having a ferrofluid therein, and positioning a thermally conductive non-magnetic metal interface system in the ferrofluid assembly and in thermal contact with the ferrofluid to evenly distribute a thermal load throughout the ferrofluid.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention is described with respect to the use of an x-ray tube as used in a computed tomography (CT) system. However, it will be appreciated by those skilled in the art that the present invention is equally applicable for use in other systems that require the use of an x-ray tube. Such uses include, but are not limited to, x-ray imaging systems (for medical and non-medical use), mammography imaging systems, x-ray diffraction, and radiographic (RAD) systems.

Moreover, the present invention will be described with respect to use in an x-ray tube. The present invention will be described with respect to a "third generation" CT medical imaging scanner, but is equally applicable with other CT systems, such as a baggage scanner or a scanner for other non-destructive industrial uses.

Figure 1:
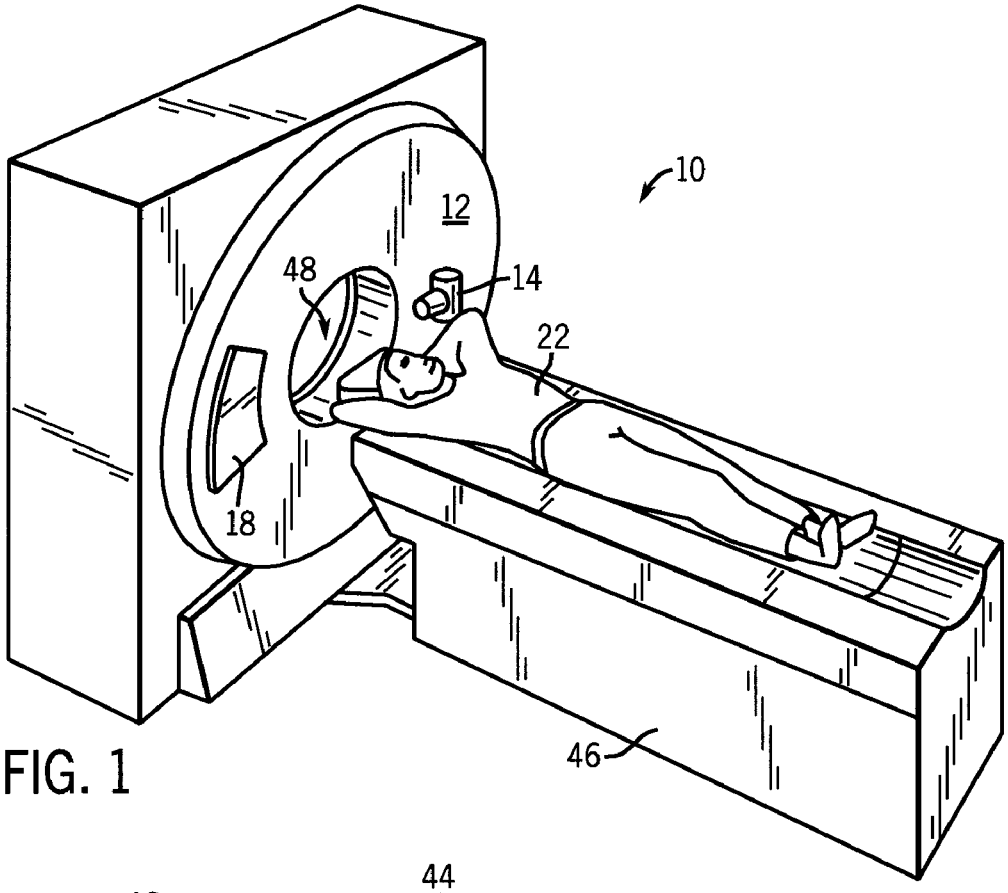
FIG. 1 is a pictorial view of a CT imaging system that can benefit from incorporation of an embodiment of the present invention.
Figure 2:
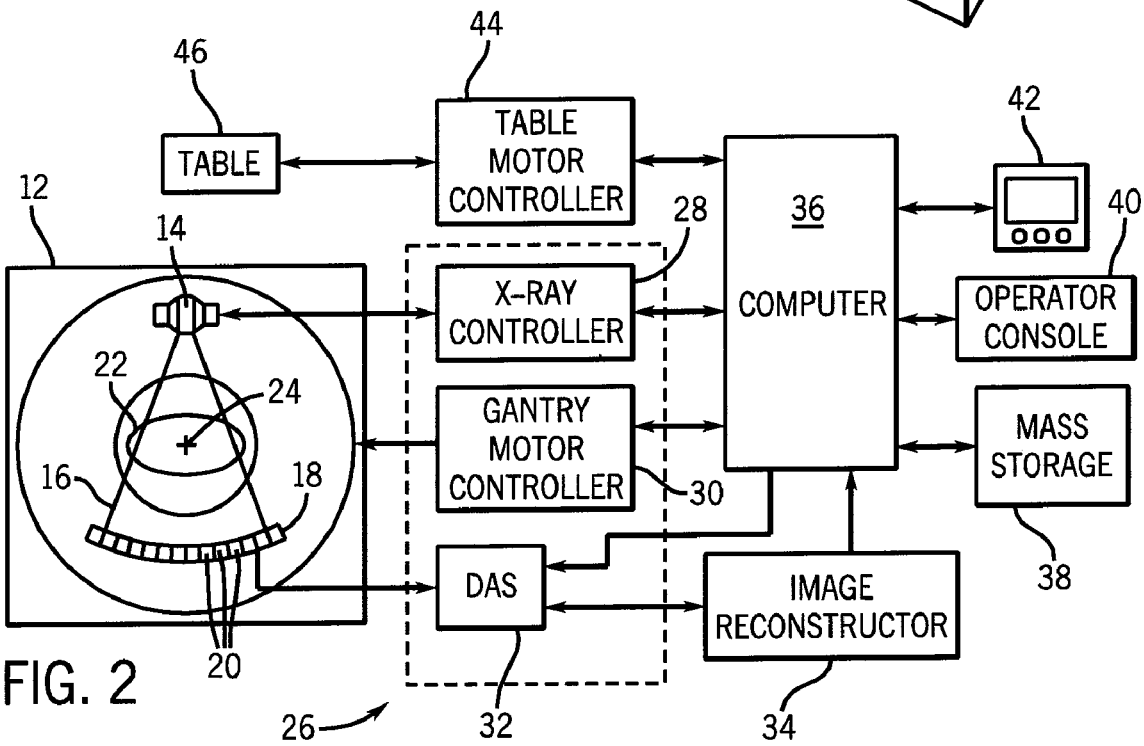
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray tube 14 that projects a beam of x-rays 16 toward a detector array 18 on the opposite side of the gantry 12. Detector array 18 is formed by a plurality of detectors 20 which together sense the projected x-rays that pass through a medical patient 22. Each detector 20 produces an electrical signal that represents the intensity of an impinging x-ray beam and hence the attenuated beam as it passes through the patient 22. While the embodiment of FIGS. 1 and 2 includes only a single x-ray tube 14 and detector array 18, it is also envisioned that CT imaging system 10 have a different architecture including multiple x-ray sources and detector arrays.

During a scan to acquire x-ray projection data, gantry 12 and the components mounted thereon rotate about a center of rotation 24. Rotation of gantry 12 and the operation of x-ray tube 14 are governed by a control mechanism 26 of CT system 10. Control mechanism 26 includes an x-ray controller 28 that provides power and timing signals to an x-ray tube 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves portions of patient 22 through a gantry opening 48.

Figure 3:
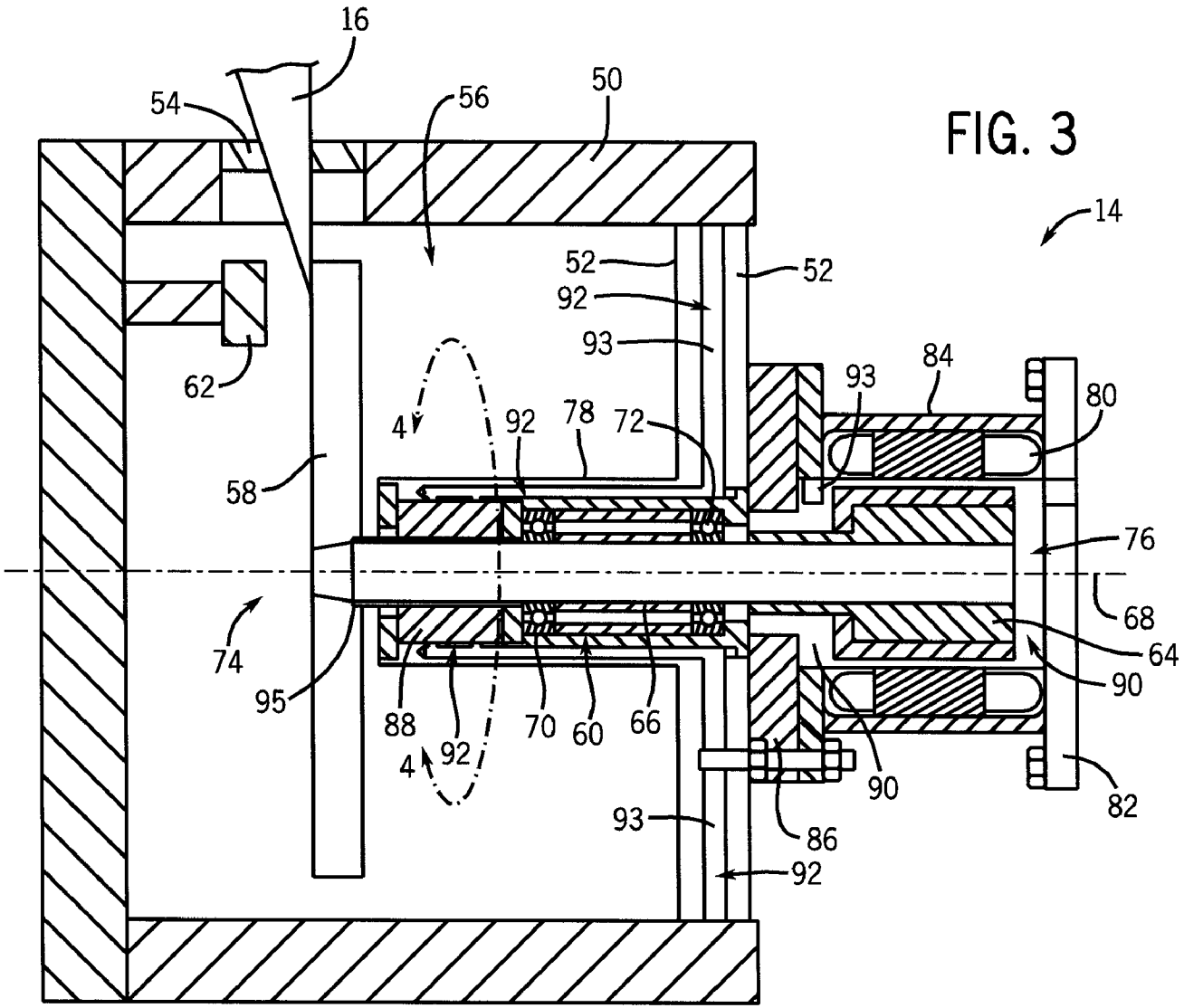
FIG. 3 illustrates a cross-sectional view of an x-ray tube that can benefit from incorporation of an embodiment of the present invention.

FIG. 3 illustrates a cross-sectional view of an x-ray tube 14 according to an embodiment of the present invention. The x-ray tube 14 includes a frame 50 and an anode backplate 52. A radiation emission passage 54 allows x-rays 16 to pass therethrough. Frame 50 and anode backplate 52 enclose an x-ray tube volume 56, which houses a target, or anode, 58, a bearing assembly 60, and a cathode 62. X-rays 16 are produced when high-speed electrons are suddenly decelerated when directed from the cathode 62 to the anode 58 via a potential difference therebetween of, for example, 60 thousand volts or more in the case of CT applications. The x-rays 16 are emitted through radiation emission passage 54 toward a detector array, such as detector array 18 of FIG. 2. To avoid overheating the anode 58 from the electrons, a rotor 64 and a center shaft 66 rotate the anode 58 at a high rate of speed about a centerline 68 at, for example, 90-250 Hz. Anode 58 is attached to center shaft 66 at a first end 74, and the rotor 64 is attached to center shaft 66 at a second end 76.

The bearing assembly 60 includes a front bearing 70 and a rear bearing 72, which support center shaft 66 to which anode 58 is attached. In a preferred embodiment, front and rear bearings 70, 72 are lubricated using grease or oil. Front and rear bearings 70, 72 are attached to center shaft 66 and are mounted in a stem 78, which is supported by anode backplate 52. A stator 80 rotationally drives rotor 64 attached to center shaft 66, which rotationally drives anode 58.

Still referring to FIG. 3, a mounting plate 82, a stator housing 84, a stator mount structure 86, stem 78, and a ferrofluid seal assembly 88 surround an antechamber 90 into which bearing assembly 60 and rotor 64 are positioned and into which the second end 76 of center shaft 66 extends. Center shaft 66 extends from antechamber 90, through ferrofluid seal assembly 88, and into x-ray tube volume 56. The ferrofluid seal assembly 88 hermetically seals x-ray tube volume 56 from antechamber 90. Cooling passage 92 carries coolant 93 through anode backplate 52 and into stem 78 to cool ferrofluid seal assembly 88 thermally connected to stem 78. Although ferrofluid seal assembly is described above as hermetically sealing x-ray tube volume 56 from antechamber 90, it is also envisioned that the x-ray tube volume 56 is sealed from the ambient environment, with no antechamber being present.

FIG. 3 shows a conductive sleeve 95 positioned about center shaft 66 between the ferrofluid seal assembly 88 and anode 58. Conductive sleeve 95 is preferably constructed of a highly conductive material such as copper or aluminum. Conductive sleeve 95 is configured to draw heat generated from the anode and transfer the heat through center shaft 66 and away from ferrofluid seal assembly 88, as will be explained in greater detail below.

Figure 4:
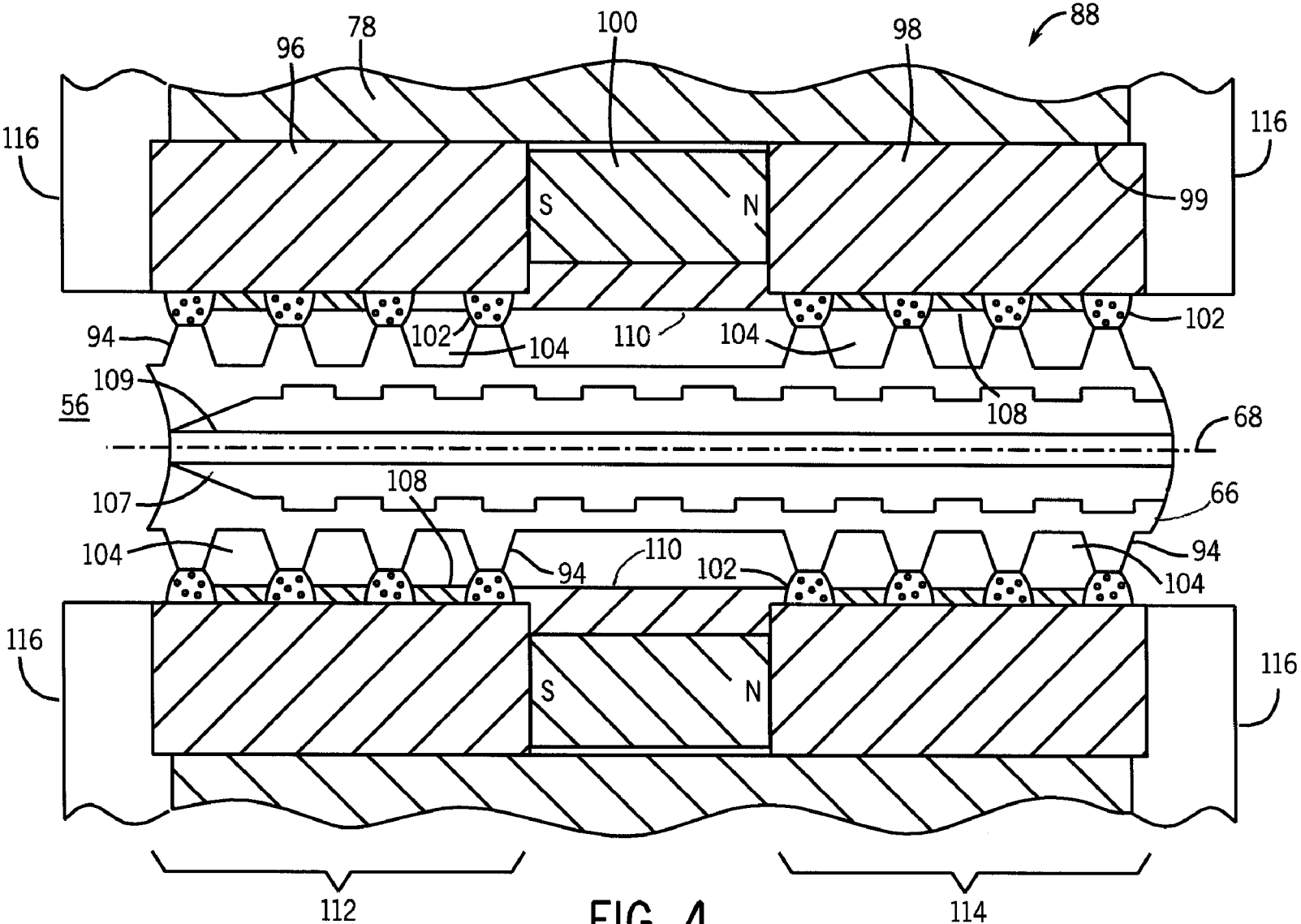
FIG. 4 illustrates a cross-sectional view of a ferrofluid seal assembly according to the present invention.

FIG. 4 illustrates a cross-sectional view of the ferrofluid seal assembly 88 of FIG. 3. A pair of annular pole pieces 96, 98 abut an interior surface 99 of stem 78 and encircle center shaft 66. An annular permanent magnet 100 is positioned between pole piece 96 and pole piece 98. In a preferred embodiment, center shaft 66 includes annular rings 94 extending therefrom toward pole pieces 96, 98. Alternatively, however, pole pieces 96, 98 may include annular rings extending toward center shaft 66 instead of, or in addition to, annular rings 94 of center shaft 66. A ferrofluid 102 is positioned between each annular ring 94 and corresponding pole piece 96, 98, thereby forming cavities 104. Magnetization from permanent magnet 100 retains the ferrofluid 102 positioned between each annular ring 94 and corresponding pole piece 96, 98 in place. In this manner, multiple stages of ferrofluid 102 are formed that hermetically seal the pressure of gas in the antechamber 90 of FIG. 3 from a high vacuum formed in x-ray tube volume 56. As shown, FIG. 4 illustrates eight stages of ferrofluid 102, the eight stages being split into two ferrofluid seal groups 112, 114 each having four stages of ferrofluid. Each stage of ferrofluid 102 withstands 1-3 psi of gas pressure during rotation of center shaft 66 about centerline 68. Accordingly, one skilled in the art will recognize that the number and spacing of stages of ferrofluid 102 may be increased or decreased, depending on the difference in pressure between the antechamber 90 and the x-ray tube volume 56. Ferrofluid 102 is preferably comprised of a hydrocarbon-based, ester-based, silicon-based, or fluorocarbon-based oil; however, it is also envisioned that other suitable substances may be used.

Also shown in FIG. 4 is a plurality of non-magnetic conductive interfaces 108, 110 included in the ferrofluid seal assembly 88 to enhance conductive influence on the ferrofluid 102 operating temperature and operate as heat transfer mechanisms. As pole pieces 96, 98 are commonly comprised of a stainless steel material that is not an efficient conductor, non-magnetic conductive interfaces 108, 110 improve the conduction of thermal loads in the ferrofluid. The non-magnetic conductive interfaces 108, 110 conductively remove heat from ferrofluid 102 and axially spread the thermal load throughout the ferrofluid seal assembly 88. More specifically, as shown in the embodiment of FIG. 4, conductive rings 108 are positioned between each of the stages of ferrofluid 102. This positioning of conductive rings 108 between ferrofluid 102 promotes a balanced thermal spread between each of the stages of ferrofluid 102 and reduces peak temperatures in individual stages of ferrofluid 102.

Conductive connectors 110 are also included in ferrofluid seal 88 to aid in thermal spread. The conductive connectors 110 are positioned between groupings 112, 114 of the stages of ferrofluid 102. Thus, in addition to the thermal spread between individual stages of ferrofluid 102 that is enhanced by conductive rings 108, thermal spread between seal groupings 112, 114 can be enhanced by inclusion of conductive connectors 110 in the ferrofluid seal assembly 88. Thus, peak temperature in the ferrofluid seal assembly 88 is maintained below a certain critical temperature by way of the plurality of non-magnetic conductive interfaces 108, 110.

In the embodiment of FIG. 4, center shaft 66 also includes a cavity 107 extending through the center thereof. An inner shaft conductor 109 is inserted into cavity 107 to draw heat out of the ferrofluid seal assembly 88 and lower temperature therein. The inner shaft conductor 109 receives a thermal load transferred thereto by way of the ferrofluid 102, center shaft 66, and conductive sleeve 95 (shown in FIG. 3) and transfers the load out of the ferrofluid seal assembly 88. In one embodiment, inner shaft conductor 109 is a rod constructed of a highly conductive material (e.g., copper, aluminum) that is inserted into cavity 107. In an alternate embodiment, inner shaft conductor 109 is in the form of or coupled to a heat pipe positioned in cavity 107. As is known in the art, a typical heat pipe consists of a sealed hollow tube constructed of a thermoconductive metal, such as copper or aluminum. The heat pipe also contains a relatively small quantity of a working fluid or coolant (such as water, ethanol, or mercury) with the remainder of the pipe being filled with vapor phase of the working fluid, all other gases being excluded. The inner shaft conductor 109 extends from a portion of center shaft 66 starting at ferrofluid seal assembly 88 and extending therethrough towards second end 76 of center shaft, as shown in FIG. 3, thus promoting heat dissipation and providing an additional mechanism for reducing temperature in the ferrofluid seal assembly 88. While the inner shaft conductor 109 has been described above as a conductive rod or heat pipe, it is also envisioned that other suitable mechanisms can be included in cavity 107 to remove heat from ferrofluid seal assembly 88.

Cavity 107 is further formed as a threaded or featured inner cavity. The threaded inner cavity reduces thermal resistance between the cavity 107 and the ferrofluid 102. Thus, the threaded inner cavity further improves heat transfer from the ferrofluid 102 into the cavity 107 and the inner shaft conductor 109 therein. The threaded inner cavity also may increase fluid turbulence of a coolant flowing in cavity 107, thereby further increases heat transfer out of the ferrofluid seal assembly 88. While cavity 107 is shown as threaded or featured in FIG. 4, it is also envisioned that inner shaft conductor 109 be threaded or featured instead of cavity 107. Such a configuration would again improve heat transfer between the cavity 107 and the inner shaft conductor 109 and also increase fluid turbulence of the coolant in the cavity 107. Cavity 107 can also be configured to taper at the end nearest to anode 58 (shown in FIG. 3). Tapering of cavity 107 allows cavity 107 to extend further through central shaft 66, thus extending the cooling region therein.

According to an embodiment of the present invention, an insulative material 116 can also be added to the x-ray tube 14 of FIG. 3 to aid in preventing unwanted thermal loads from being transferred to ferrofluid seal assembly 88. As shown in FIG. 4, insulative material 116 is positioned to prevent any bearing or center shaft 66 thermal load from influencing the ferrofluid seal assembly 88. The insulative material 116 also isolates ferrofluid seal assembly 88 from any thermal load induced by anode 58 by way of convection.

Therefore, according to one embodiment of the present invention, a hermetic sealing system includes a chamber enclosing a high vacuum positioned within an ambient environment, a rotatable shaft having a first portion extending into the chamber and a second portion extending away from the chamber, and a ferrofluid seal assembly positioned about the rotatable shaft and positioned between the first portion and the second portion, the ferrofluid seal assembly having a ferrofluid therein that fluidically seals the chamber. The hermetic sealing system also includes a plurality of non-magnetic passive or active conductive elements positioned within the ferrofluid seal assembly and in thermal contact with the ferrofluid.

In accordance with another embodiment of the present invention, an x-ray tube includes a vacuum enclosure having a high vacuum formed therein, a ferrofluid seal positioned between the vacuum enclosure and a surrounding environment and having a plurality of ferrofluid seal stages, and a rotatable shaft extending from within the vacuum enclosure and into the surrounding environment through the hermetic seal, wherein the rotatable shaft includes a cavity therein extending from the hermetic seal and out into the surrounding environment. The x-ray tube also includes a plurality of heat transfer mechanisms, each heat transfer mechanism thermally connected to at least two ferrofluid seal stages to axially spread a thermal load of the at least two ferrofluid stages.

In accordance with yet another embodiment of the present invention, a method of manufacturing an x-ray tube comprises the steps of providing a rotatable shaft, attaching an anode to a rotatable shaft, disposing the anode in a first volume, and attaching a rotor and a bearing assembly to the rotatable shaft outside of the first volume. The method also includes the steps of attaching a ferrofluid seal assembly to the rotatable shaft to hermetically seal the first volume, the ferrofluid seal assembly having a ferrofluid therein, and positioning a thermally conductive non-magnetic metal interface system in the ferrofluid assembly and in thermal contact with the ferrofluid to evenly distribute a thermal load throughout the ferrofluid.

The present invention has been described in terms of the preferred embodiment, and it is recognized that equivalents, alternatives, and modifications, aside from those expressly stated, are possible and within the scope of the appending claims.

What is claimed is:

1. A hermetic sealing system comprising:

a chamber enclosing a high vacuum and positioned within an ambient environment;

a rotatable shaft having a first portion extending into the chamber and a second portion extending away from the chamber;

a ferrofluid seal assembly positioned about the rotatable shaft and positioned between the first portion and the second portion, the ferrofluid seal assembly having a ferrofluid therein that fluidically seals the chamber; and a plurality of non-magnetic passive or active conductive elements positioned within the ferrofluid seal assembly and in thermal contact with the ferrofluid.

2. The hermetic sealing system of claim 1 wherein the ferrofluid seal assembly further comprises:

a pole piece encircling the rotatable shaft;

a plurality of annular rings extending from one of the pole piece and the rotating shaft toward the other of the pole piece and the rotating shaft such that a plurality of gaps is formed between the plurality of annular rings and the other of the pole piece and the rotating shaft, the ferrofluid deposited in the plurality of gaps; and at least one magnet encircling the rotatable shaft and positioned such that the plurality of gaps is disposed in a magnetic field formed by the magnet.

3. The hermetic sealing system of claim 2 wherein the ferrofluid deposited in the plurality of gaps forms a plurality of ferrofluid stages.

4. The hermetic sealing system of claim 3 wherein the plurality of non-magnetic conductive elements further comprises:

at least one conductive ring positioned between the plurality of ferrofluid stages; and at least one conductive connector positioned between adjacent groups of ferrofluid stages.

5. The hermetic sealing system of claim 1 wherein the rotatable shaft further comprises a third portion encircled by the ferrofluid seal, the third portion having a cavity through a center thereof extending from the third portion to the second portion.

6. The hermetic sealing system of claim 5 further comprising at least one of a high conductivity rod extending through the cavity and a heat pipe extending through the cavity.

7. The hermetic sealing system of claim 5 wherein the plurality of non-magnetic conductive elements further comprises a high conductivity sleeve positioned about the first portion of the rotatable shaft.

8. The hermetic sealing system of claim 5 wherein the cavity is a threaded or featured inner cavity configured to reduce thermal resistance between the cavity and the ferrofluid and increase fluid turbulence of a coolant within the cavity.

9. The hermetic sealing system of claim 1 wherein the cavity is tapered at an end nearest the chamber.

10. The hermetic sealing system of claim 1 further comprising at least one insulative member configured to insulate the ferrofluid seal assembly from an external thermal load.

11. The hermetic sealing system of claim 1 further comprising:

an x-ray tube target attached to the first portion of the rotatable shaft; and a rotor and a bearing assembly attached to the second portion of the rotatable shaft.

12. An x-ray tube comprising:

a vacuum enclosure having a high vacuum formed therein;

a ferrofluid seal positioned between the vacuum enclosure and a surrounding environment and having a plurality of ferrofluid seal stages;

a rotatable shaft extending from within the vacuum enclosure and into the surrounding environment through the hermetic seal, wherein the rotatable shaft includes a cavity therein extending from the hermetic seal and out into the surrounding environment; and a plurality of heat transfer mechanisms, each heat transfer mechanism thermally connected to at least two ferrofluid seal stages to axially spread a thermal load of the at least two ferrofluid stages.

13. The x-ray tube of claim 12 further comprising a plurality of annular rings formed on the rotatable shaft, each annular ring coupled to a respective ferrofluid seal stage.

14. The x-ray tube of claim 12 further comprising at least one of:

a high thermal conductivity rod extending through the cavity of the rotatable shaft;

a heat pipe extending through the cavity of the rotatable shaft; and a high conductivity sleeve positioned about the rotatable shaft, the high conductivity sleeve extending from the hermetic seal and into the vacuum enclosure.

15. The x-ray tube of claim 12 wherein the cavity is tapered at an end nearest the vacuum enclosure.

16. The x-ray tube of claim 12 further comprising at least one thermally insulative member configured to insulate the hermetic seal from an external thermal load.

17. The x-ray tube of claim 12 further comprising at least one magnet encircling the rotatable shaft and positioned such that the hermetic seal is disposed in a magnetic field formed by the magnet.

18. The x-ray tube of claim 12 wherein the plurality of heat transfer mechanisms are composed of a non-magnetic, conductive material.

19. A method of manufacturing an x-ray tube comprising the steps of:

providing a rotatable shaft;

attaching an anode to a rotatable shaft;

disposing the anode in a first volume;

attaching a rotor and a bearing assembly to the rotatable shaft outside of the first volume;

attaching a ferrofluid seal assembly to the rotatable shaft to hermetically seal the first volume, the ferrofluid seal assembly having a ferrofluid therein; and positioning a thermally conductive non-magnetic metal interface system in the ferrofluid assembly and in thermal contact with the ferrofluid to evenly distribute a thermal load throughout the ferrofluid.

20. The method of claim 19 wherein the step of positioning the conductive non-magnetic metal interface system comprises positioning a separate interface of the thermally conductive non-magnetic metal interface system between each of a plurality of seal stages in the ferrofluid seal assembly.

21. The method of claim 19 further comprising the step of positioning one of a high conductivity rod and a heat pipe to extend through a cavity of the rotatable shaft.

22. The method of claim 19 further comprising the step of positioning a high conductivity sleeve about the rotatable shaft.

23. The method of claim 19 further comprising the step of positioning at least one thermally insulative member on opposing ends of the ferrofluid seal assembly.

* * * * *